US005809880A

United States Patent [19]

Okuda et al.

[11] Patent Number: 5,809,880

[45] Date of Patent: Sep. 22, 1998

[54] STENCIL PRINTING SHEET WITH THERMAL FUSION PREVENTING LAYER

[75] Inventors: Sadanao Okuda; Satoru Komata; Hirohide Hashimoto, all of Tokyo, Japan

[73] Assignee: Riso Kagaku Corporation, Tokyo, Japan

[21] Appl. No.: 909,542

[22] Filed: Aug. 12, 1997

Related U.S. Application Data

[63] Continuation-in-part of Ser. No. 574,547, Dec. 19, 1995, abandoned.

[30] Foreign Application Priority Data

Dec. 21, 1994 [JP] Japan ..... 6-318631

[51] Int. Cl.[6] ..... B41N 1/24

[52] U.S. Cl. ..... 101/128.21

[58] Field of Search ..... 101/127, 128.21, 101/128.4

[56] References Cited

U.S. PATENT DOCUMENTS

| | | | |
|---|---|---|---|
| 4,707,404 | 11/1987 | Morishita et al. | 428/335 |
| 4,948,775 | 8/1990 | Tsuji et al. | 503/207 |
| 5,061,565 | 10/1991 | Aoki et al. | 101/128.4 |
| 5,308,824 | 5/1994 | Matsushita et al. | 503/226 |

FOREIGN PATENT DOCUMENTS

| | | |
|---|---|---|
| 453579 | 10/1991 | European Pat. Off. . |
| 22053 | 2/1982 | Japan . |
| 120499 | 7/1982 | Japan . |
| 40196 | 2/1986 | Japan . |
| 114894 | 6/1986 | Japan . |
| 125897 | 6/1986 | Japan . |
| 24797 | 1/1989 | Japan . |
| 135684 | 5/1989 | Japan . |
| 155906 | 6/1994 | Japan . |
| 2277058 | 10/1994 | United Kingdom . |

*Primary Examiner*—Stephen R. Funk

*Attorney, Agent, or Firm*—Fay, Sharpe, Beall, Fagan, Minnich & McKee

[57] ABSTRACT

A stencil printing sheet is disclosed comprising a resin film and optionally a support for the resin film which is fixed to the resin film with an adhesive, wherein the resin film has a layer for preventing thermal fusion including a polyethylene wax and arranged on one surface thereof. The stencil printing sheet does not cause breakage of the resinous film during a perforating process even at a high printing speed using a thermal head, provides excellent perforation images, and exhibits a long-lasting, excellent resistance to thermal fusion.

11 Claims, No Drawings

STENCIL PRINTING SHEET WITH THERMAL FUSION PREVENTING LAYER

This application is a continuation-in-part of application Ser. No. 08/574,547, filed on Dec. 19, 1995, now abandoned.

BACKGROUND OF THE INVENTION

1. Field of the Invention

The present invention relates to a stencil printing sheet. More particularly, the invention relates to a stencil printing sheet which has an excellent resistance to thermal fusion with a thermal head (exothermic elements) used in a device for preparing a perforated stencil printing sheet.

2. Description of the Related Art

In the preparation of perforated stencil printing sheet, the following two methods are generally used. In one method, a manuscript paper is affixed to a stencil printing sheet, and then infrared rays are irradiated to them to make perforations on the sheet corresponding to blackened portions of the manuscript. The other method uses a thermal head. In this method, the information contained in a manuscript paper is converted to electric signals, and perforations are made in a stencil printing sheet by predetermined amounts of heat generated in a thermal head according to the signals. In recent years, the former method employing infrared rays has become less popular. On the other hand, the latter method using a thermal head is now adopted in most devices for preparing perforated stencil printing sheets. Therefore, stencil printing sheets which properly fit to thermal heads are desired.

The rate at which a stencil printing sheet is perforated by a thermal head used in a device for preparing perforated stencil printing sheets has become increasingly high. For example, the setting or print processing capacity by a thermal head for a word processor has increased approximately 4-to-5 fold during the past 5 years. This is partly due to improved printing speed. With a high printing speed, a thermal head and a film of a stencil printing sheet are adhered to each other by thermal fusion when the sheet is perforated, and as a result, breakage of the resin film of a stencil printing sheet tends to occur. This phenomenon is caused by the fact that the film is adhered by fusion to the exothermic elements where releasability of the exothermic elements of the thermal head and the surface of a stencil printing sheet is poor when the thermal head moves relative to the stencil printing sheet while heating the surface thereof. Moreover, if the transfer speed of a thermal head relative to a stencil printing sheet increases, considerable amount of breakage of the film is caused. In addition, under these conditions, perforations will be made in portions of a stencil printing sheet other than the portions corresponding to a manuscript. As a result, quality of image formed on the printed material decreases.

Conventionally, a number of methods have been proposed to prevent thermal fusion of a stencil printing sheet. For example, a method of applying a silicone resin and/or silicone oil to the film surface of a stencil printing sheet is disclosed in Japanese Patent Application Laid-open (kokai) Nos. 48-30,570, 58-92,595, 61-295,098, 1-238,992, and 5-64,991. Also, a method of providing a surfactant layer on the film surface of a stencil printing sheet is disclosed in Japanese Patent Application Laid-open (kokai) No. 6-41, 234. Further, a method of providing a wax layer on the film surface of a stencil printing sheet is disclosed in Japanese Patent Application Laid-open (kokai) No. 60-19,592.

However, in methods employing a liquid substance such as a silicone oil or a surfactant, these components are transferred as time passes to the support layer which supports a resin film, thereby gradually deteriorating the effect of the liquid substances on the prevention of thermal fusion. On the other hand, although methods of using thermosetting resins such as silicone resins are excellent in preventing thermal fusion and do not have the disadvantage of the transfer of resin components to the support layer, these methods also have a drawback that the thermosetting resin prevents the perforation of a film by exothermic elements.

To prevent this, a silicone resin and silicone oil are used in combination, or alternatively, a surfactant and water-soluble polymer are used in combination. But even in such cases, perforating capacity decreases due to the presence of the polymer. Alternatively, the mixed components separate as time passes (causes bleeding phenomenon), thereby reducing the effect of preventing thermal fusion.

If a wax layer is provided, the wax will not be transferred to a support layer which supports a resin film, nor will the film perforating capacity of thermal elements be reduced. However, the effect on preventing thermal fusion is still insufficient when perforations are made at a high printing speed.

SUMMARY OF THE INVENTION

Accordingly, an object of the present invention is to solve the above problems and to provide a stencil printing sheet which provides excellent perforation images without causing thermal fusion upon contact with a thermal head even under conditions of a high printing speed, and which also provides long-lasting resistance to thermal fusion.

In one aspect of the present invention, there is provided a stencil printing sheet comprising a resin film and optionally a support for the resin film which is adhered to the resin film with an adhesive, wherein the resin film has a layer for preventing thermal fusion comprising a polyethylene wax arranged on one surface thereof.

The average molecular weight of the polyethylene wax is preferably not more than 10,000 and the melting point of the polyethylene wax is at least 100° C.

The layer for preventing thermal fusion is desirably prepared by applying a polyethylene wax on the surface of the resin film in an amount of from 0.01 to 5 $g/m^2$ on a dry basis.

DETAILED DESCRIPTION OF THE PREFERRED EMBODIMENTS

Since the stencil printing sheet of the present invention employs a polyethylene wax having remarkably excellent effects of preventing thermal fusion compared with conventional thermal fusion preventing layers, it is possible to obtain perforated images providing excellent manuscription reproduction without causing breakage of resin films even at high printing speed. Moreover, the polyethylene wax does not transfer to the support layer as time passes. In addition, since the polyethylene wax is composed of a single component, it causes no bleeding phenomenon, thereby exhibiting a long-lasting effect of preventing thermal fusion.

The polyethylene wax used in the present invention is preferably applied to the resinous film surface of the stencil printing sheet as a thermal fusion inhibiter. The average molecular weight of the polyethylene wax is preferably not more than 10,000 to prevent a decrease in perforation quality of the resin film. More preferably, it is in the range of 500 to 5,000. The melting point of the polyethylene wax used in accordance with the present invention is at least 100° C. The use of polyethylene wax in accordance with these properties assures the below-described remarkable effects compared with the prior art:

i) When the melting point is defined to be equal to or higher than 100° C., even when the temperature of the thermal head itself elevates due to continuous perforation operations and the polyethylene wax comes to be in a molten state, the thermal fusion prevention layer does not become sticky. Thus, a consistent running property can be obtained. Therefore, resin film is prevented from being torn, even under high speed printing conditions involving use of a thermal head. As a result, perforation images having excellent text reproducibility can be obtained. Sustained thermal fusion preventive effects can also be obtained over prolonged periods without inviting occurrence of a bleeding phenomenon;

ii) When the molecular weight is not less than 500, the thermal fusion preventive layer comes to have enhanced film strength without becoming sticky. Therefore, even when a stencil printing sheet is placed thereon, transfer of polyethylene wax onto the support side of another stencil sheet can be prevented; and, iii) When the molecular weight is not more than 10,000, perforation properties of resin film are not impeded during perforation by a thermal head.

The polyethylene wax is desirably applied in an amount of 0.01–5 g/m$^2$, and preferably 0.1–2 g/m$^2$ on a dry basis. If the amount is too small, the effect of preventing thermal fusion is insufficient and breakage of a resin film is easily caused. On the other hand, excessive amounts result in poor perforation performance.

The polyethylene wax may be used in a solid form such as flake or in an emulsion in which the wax is dispersed in water. The specific form of the polyethylene wax is suitably selected according to the method of applying the wax onto the surface of a resin film. The polyethylene wax may have a carboxyl group or a hydroxyl group in the molecule. Also, it may be substituted by other modification groups such as methyl and phenol group.

The layer for preventing thermal fusion comprising a polyethylene wax may optionally contain an antistatic and other additives. Examples of the antistatic additives include organic sulfonic metal salts, quaternary ammonium salts, alkyl phosphate, and other common antistatics.

The resin film which is used in the present invention may be made of a polyethylene, polypropylene, polyvinyl chloride, polyvinylidene chloride, polyesters, polystyrene, polyurethane, polycarbonate, acrylic resin, or silicone resin. Among them, polyvinyl chloride and polyester are particularly preferred.

The thickness of the resin film is generally from 0.5 to 20 $\mu$m, and more particularly from 1 to 15 $\mu$m.

The stencil printing sheet of the present invention may be a compound material obtained by sticking a resin film and a support for supporting the resin film together with an adhesive. Alternatively, it may be substantially constituted by a resin film only. The support for supporting the resin film may be made of a porous material which allows stencil printing ink to pass through, or the support may be a flexible sheet which is non-ink-permeable.

When printing is to be performed via a support, a porous supporting material which permits passage of stencil printing ink, including Tengjoh (a high quality Japanese paper comprising mulberry paper), woven fabrics, nonwoven fabrics, etc. are used. In the case where perforated stencil printing sheet is produced using a stencil printing sheet having a support, but before printing, the support is peeled off from the sheet, and thus, printing is performed only with a resin film, a flexible sheet such as a resin sheet, woven fabric, nonwoven fabric, printing paper, etc. may be used. In this connection, stencil printing sheets substantially composed of a resin film do not require any support therefor.

The adhesive for sticking a resin film and a support together is not particularly limited insofar as it can stick a resin film to a support, and can be molten be heat from exothermic elements to form perforations.

EXAMPLES

The present invention will hereinafter be described by way of examples, which should not be construed as limiting the present invention thereto.

Example 1

A 2.0 $\mu$m thick polyester film and a porous Tengjoh paper having a basis weight of 10 g/m$^2$ were fixed to each other using a vinyl acetate resin (in an amount of about 1.0 g/m$^2$ on a dry basis) and dried. Subsequently, the polyethylene wax indicated in Table 1 was applied on the polyester film surface in an amount of 0.5 g/m$^2$ on a dry basis.

Examples 2–4

The procedure of Example 1 was repeated except that the polyethylene wax was replaced by those indicated in Table 1 to obtain stencil printing sheets.

Example 5

A polyethylene wax identical to that used in Example 1 was applied onto one surface of a 2.0 $\mu$m thick polyester film in an amount of 0.5 g/m$^2$ on a dry basis to obtain a stencil printing sheet.

Comparative Examples 1–7

The procedure of Example 1 was repeated except that the polyethylene wax was replaced by those indicated in Table 1 to obtain stencil printing sheets.

TABLE 1

| | Names of the products (manufacturer) | Amount (wt %) | Average molecular weight | Melting point |
|---|---|---|---|---|
| Example 1, 5 | Highwax 1120II (Mitsui Petrochemical Industries, Ltd.) | 100 | 1,200 | 107° C. |
| Example 2 | Highwax 4051E (Mitsui Petrochemical | 100 | 3,200 | 115° C. |

TABLE 1-continued

| | Names of the products (manufacturer) | Amount (wt %) | Average molecular weight | Melting point |
|---|---|---|---|---|
| | Industries, Ltd.) | | | |
| Example 3 | Sunwax E-300 (Sanyo Chemical Industries, Ltd.) | 100 | 2,000 | 104° C. |
| Example 4 | PDX 6641 (Johnson Polymer Co.) | 100 | 5,000 | 115° C. |
| Comparative Example 1 | LG wax (Montan wax) (BASF) | 100 | 800 | 81~86° C. |
| Comparative Example 2 | KF-96-100,000 cP (Silicone oil) (Shin-etsu Chemical Co., Ltd.) | 100 | — | — |
| Comparative Example 3 | KS-770A (Thermosetting-type silicone resin) KF-96-1,000 cp [Silicone oil] (Shin-etsu Chemical Co., Ltd.) | 50<br>50 | — | — |
| Comparative Example 4 | Hostaphat KL 340 [Phosphate surfactant] (Matsumoto Kosho Ltd.) Polyethylene glycol 1540 [Water-soluble polymer] (Wako Pure Chemical Industries, Ltd.) | 50<br>50 | — | — |
| Comparative Example 5 | Nisseki microcrystalline wax 180 (Nippon petrochemical, Ltd.) | 100 | — | 84° C. |
| Comparative Example 6 | Paraffin wax (Nippon seirou, Ltd.) | 100 | — | 52.4° C. |
| Comparative Example 7 | Carnauba wax (Kato yoko, Ltd.) | 100 | — | 80~86° C. |

Test Examples

The stencil printing sheets obtained in Examples 1 to 5 and Comparative Examples 1 to 7 were evaluated for their resistance to thermal fusion (the effect of polyethylene wax on the prevention of thermal fusion), running stability changes in the resistance as time passes, and perforation quality of the stencil printing sheets.

(1) Resistance to thermal fusion:

Each stencil printing sheet was perforated by using a word processor [Oasis 30 AX301 manufactured by Fujitsu Ltd., printing speed: 190 characters/sec. (printing: 10.5 point character, line space: 3.6 mm)]. The perforated stencil printing sheet thus obtained was subjected to printing with a stencil printing device (model RA-205 manufactured by Riso Kagaku Kogyo K.K.). Breakage of the film was visually confirmed on resulting prints. The symbol "O" indicates that images perfectly identical to those of the original manuscript were obtained, whereas the symbol "X" indicates that images different from those of the original manuscript were obtained and film breakage occurred.

(2) Change is the resistance to thermal fusion as time passes:

Each stencil printing sheet was allowed to stand for 1 month at 50° C. in a rolled state, i.e., in a state where the layer for preventing thermal fusion contacts the support. Thereafter, each stencil printing sheet was evaluated in a manner similar to that described in (1) above.

(3) Perforation quality:

Each stencil printing sheet was perforated by using a word processor used in (1) above. Perforation qualities were visually observed. The symbol "O" indicates that images exactly reflecting those of the original manuscript were obtained, whereas the symbol "X" indicates that images different from those of the original manuscript were obtained and that insufficient perforations were made.

(4) Running stability:

It was evaluated after stencil printing was performed continuously for twenty sheets by use of a solid original text and a stencil printing apparatus (RA205, tradename, by Riso Kagake Corporation). In the evaluation, the shrinkage of the prints obtained from the 20th sheet was visually observed and compared with that of the original text. When the shrinkage of the print was comparable to the text, rating "O" was given, and when the print was considerably shrunk, rating "X" was given. As used herein, shrinkage of a print refers to a phenomenon that the stencil printing sheet shrinks as the thermal head runs during plate-making to cause shrinkage of the print in the longitudinal direction of the text.

TABLE 2

| | Resistance to thermal fusion | Running stability | Changes as time passes | Perforation Quality |
|---|---|---|---|---|
| Example 1 | O | O | O | O |
| Example 2 | O | O | O | O |
| Example 3 | O | O | O | O |
| Example 4 | O | O | O | O |
| Example 5 | O | O | O | O |
| Comparative Example 1 | X | X | O | O |

TABLE 2-continued

| | Resistance to thermal fusion | Running stability | Changes as time passes | Perforation Quality |
|---|---|---|---|---|
| Comparative Example 2 | O | O | X | O |
| Comparative Example 3 | O | O | X | X |
| Comparative Example 4 | O | O | X | O |
| Comparative Example 5 | O | X | O | O |
| Comparative Example 6 | X | X | O | O |
| Comparative Example 7 | X | O | O | O |

From Table 2 above, it is understood that the stencil printing sheets of the present invention each having a layer for preventing thermal fusion do not cause breakage of film during perforation, provide printed images faithful to the original manuscript, and exhibit long-lasting, excellent resistance to thermal fusion and running stability.

According to the present invention, a stencil printing sheet can be provided having a long-lasting, excellent resistance to thermal fusion and causing no breakage of resinous film during perforating processes even under conditions of high speed printing using a thermal head. In addition, when a polyethylene wax having an average molecular weight of not more than 10,000 was used in an amount of 0.01 to 5 $g/m^2$ on a dry basis, images faithful to those of an original manuscript can be obtained without lowering the quality of perforations in the resin film when it is perforated.

What is claimed is:

1. A stencil printing sheet comprising a resin film wherein the resin film has a layer for preventing thermal fusion comprising a polyethylene wax having a melting point of at least 100° C. and an average molecular weight of 500 to 10,000 arranged on one surface thereof.

2. The stencil printing sheet according to claim 1, wherein the average molecular weight of said polyethylene wax is 500 to 5000.

3. The stencil printing sheet according to claim 2, wherein the layer for preventing thermal fusion comprises polyethylene wax on the surface of the resin film in an amount of from 0.01 to 5 $g/m^2$ on a dry basis.

4. The stencil printing sheet according to claim 1, wherein the layer for preventing thermal fusion comprises polyethylene wax on the surface of the resin film in an amount of from 0.01 to 5 $g/m^2$ on a dry basis.

5. The stencil printing sheet according to claim 1, further comprising a support for the resin film which is adhered to the resin film with an adhesive.

6. The stencil printing sheet according to claim 5, wherein the average molecular weight of the polyethylene wax is 500 to 5000.

7. The stencil printing sheet according to claim 6, wherein the layer for preventing thermal fusion comprises polyethylene wax on the surface of the resin film in an amount of from 0.01 to 5 $g/m^2$ on a dry basis.

8. The stencil printing sheet according to claim 5, wherein the layer for preventing thermal fusion comprises polyethylene wax on the surface of the resin film in an amount of from 0.01 to 5 $g/m^2$ on a dry basis.

9. The stencil printing sheet according to claim 1, wherein said resin film is made of a resin selected from the group consisting of polyethylene, polypropylene, polyvinyl chloride, polyvinylidene chloride, polyesters, polystyrene, polyurethane, polycarbonate, acrylic resin, and silicone resin.

10. The stencil printing sheet according to claim 1, wherein said layer for preventing thermal fusion further comprises an antistatic additive.

11. The stencil printing sheet according to claim 10, wherein said antistatic additive is selected from the group consisting of organic sulfonic metal salts, quaternary ammonium salts, and alkyl phosphate.

* * * * *